United States Patent [19]

Perry

[11] Patent Number: 4,838,907

[45] Date of Patent: Jun. 13, 1989

[54] HIGH EFFICIENCY INDUSTRIAL VACUUM CLEANER

[75] Inventor: Timothy J. Perry, Danville, Calif.

[73] Assignee: Mello Manufacturing, Inc., Richmond, Calif.

[21] Appl. No.: 47,894

[22] Filed: May 7, 1987

[51] Int. Cl.[4] ..... B01D 46/00

[52] U.S. Cl. ..... 55/381; 55/350; 55/372; 55/380; 55/366; 55/429; 55/467; 55/482; 55/DIG. 45; 55/528

[58] Field of Search ..... 55/97, 350, 361, 366, 55/372, 373, 374, 378, 380, 381, 467, 471, 472, 473, 528, DIG. 45, 429, 482; 15/327 D; 210/507; 139/420 R, 389; 428/255, 35

[56] References Cited

U.S. PATENT DOCUMENTS

| | | | |
|---|---|---|---|
| 2,025,946 | 12/1935 | Wenner Gren | 55/357 |
| 2,198,568 | 4/1940 | Yonkers, Jr. | 183/37 |
| 2,295,984 | 9/1942 | Wilson | 55/472 |
| 2,713,921 | 7/1955 | Turner | 183/60 |
| 3,046,718 | 7/1962 | Ide et al. | 55/470 |
| 3,365,864 | 1/1968 | Iizima | 55/471 |
| 3,609,946 | 10/1971 | Nakagawa | 55/296 |
| 3,653,189 | 4/1972 | Miyake et al. | 55/288 |
| 3,653,190 | 4/1972 | Lee | 55/302 |
| 3,835,626 | 9/1974 | Miyake et al. | 55/319 |
| 3,966,434 | 6/1976 | Frazier | 55/97 |
| 4,072,483 | 2/1978 | Doyle | 55/372 |
| 4,257,791 | 3/1981 | Wald | 55/382 |
| 4,277,266 | 7/1981 | Dick | 55/381 |
| 4,336,035 | 6/1982 | Evenstad | 55/97 |
| 4,695,299 | 9/1987 | Spadaro | 55/429 |

FOREIGN PATENT DOCUMENTS

| | | | |
|---|---|---|---|
| 619307 | 12/1962 | Belgium | 55/337 |

OTHER PUBLICATIONS

Chicopee Industrial Fabrics, Lumite Division Chicopee Manufacturing Co. Cornelia Georgia, dtd. 10/20/67.

*Primary Examiner*—Bernard Nozick
*Attorney, Agent, or Firm*—O'Keefe & Wilkinson

[57] ABSTRACT

A vacuum cleaner uses a special self-cleaning filter arrangement including an initial fabric filter having a relatively large mesh size with a broad open mesh ratio of 5 to 15% and a total opening area of 5 to 45 times the cross section of the inlet, which inlet faces away from the filter. The initial filter is preferably backed up by secondary filters and is arranged so that dirt collected on the filter is periodically sloughed off and dropped into a receptacle after building to a critical level.

3 Claims, 3 Drawing Sheets

HIGH EFFICIENCY INDUSTRIAL VACUUM CLEANER

BACKGROUND OF THE INVENTION

1. Field of the Invention

This invention relates to vacuum or suction cleaners and more particularly to high efficiency vacuum cleaners, preferably incorporating multiple filter stages and in which the initial filter stage is self cleaning by reason of the use of a particularly designed relatively coarse mesh filter material positioned over a debris or particulate collection chamber, preferably containing an impervious dust or particulate collection bag.

2. Description of the Prior Art

A large number of so called vacuum or suction cleaners have been designed in the past. Such cleaners have usually involved the use of rotary fan means to either draw dust laden air through a filter medium such as a cloth bag or the like or to blow dust laden air into a filter such as a filter bag. Particles of dust or other debris are caught by the filter material while air passes through the filter material. As additional dust and debris is built up on the filter material the pores or openings in the filter become partially blocked with dust and other particulates. The resulting accumulation of dust itself becomes a filter of sorts and the efficiency of the filter action at first increases. Beyond a certain point, however, the efficiency of the filter decreases as the filter medium becomes more impervious to air due to a thick layer of dust and other debris accumulated on the surface of the filter. Multiple stage filtering has been used to increase the efficiency of filtering and the length of the filtering cycle, i.e. the length of time between cleaning or emptying the filter. The initial filter medium in such arrangements is usually coarser, or in other words, has larger holes or meshes in it, than subsequent filters. The dust accumulated is in such multiple stage filtering arrangements distributed between the multiple filter mediums with the larger particles being collected on the coarser initial filter medium or mediums and the smaller particles being caught on the finer filter medium or mediums. This extends the filter cycle of all the filter mediums, but is not always worth the trouble, since there are then more filters to be changed less frequently rather than less filters to be changed more frequently and the trade off is not always advantageous. Of course, the filter stages can be arranged so that the mesh size of one or more of the filters is such that the particular filter accumulates more than its share of particulates and dust so only one filter at a time usually has to be changed or cleaned. This, however, essentially defeats the original aim of increasing the number of stages in the filter cycle.

Some vacuum or suction systems have provided cleaning means such as scrapers, rappers, backflow systems and the like to aid in cleaning the filters and particularly an initial coarse filter, but such arrangements add considerable complication to the apparatus. Thus, while the filter cycle may be lengthened, the extra expense and complication is a considerable disadvantage. In addition, scrapers and rappers sometimes tend to force dust and dirt through the mesh of the filter causing an overall decrease in filter efficiency. Such systems also tend to remove a large proportion of the accumulation of dust from the filter surface so that a new layer of dust must accumulate before efficient filtering can take place. Some scrapers are arranged only to remove a certain proportion of the dust accumulation by passing the scraper along the filter at a predetermined distance from the filter surface. However, this type of arrangement tends to compact the remaining particulate accumulation on the filter at the same time and this interferes with the efficiency of the filter. Backflow type arrangements which periodically force dust layers from the filter surface are inefficient since the vacuum or suction filtration cycle cannot operate while the backflow is operating and the time available for actual cleaning or suction is thus considerably decreased. While a judicious selection of filter stages may alleviate many of the above enumerated difficulties, the principal difficulty of intermittent operation due to the necessity of periodically cleaning one or more of the filters remains. The following U.S. patents are examples of the stage of the prior art as described above.

U.S. Pat. No. 2,198,568 issued Apr. 23, 1950 to E. H. Yonkers discloses a self cleaning suction cleaner which uses a filter medium sold under the name of Dextilose. The filter material is treated with viscose to form a smooth satin finish. The viscose coating prevents adhesion of dust to the filter medium so that "a heavy accumulation of dust and dirt is not possible, the dust and dirt flaking off from the action of gravity aided by the draft of incoming air and falling into the container below." The filter thus tends "to maintain itself in a clean condition."

U.S. Pat. No. 2,295,984 issued Sept. 15, 1942 to B. C. Wilson discloses a shop type vacuum in which air enters a canister where it drops out a considerable amount of its particulate matter which is thereby removed and the air then passes upward into an inverted filter and removes additional particulates. The filtering cylinder or bag collapses each time the cleaner is shut off so the accumulation of dirt falls into the lower portion of the canister leaving the filter bag free to pass a maximum amount of air when the cleaner is again activated.

U.S. Pat. No. 2,713,921 issued Jul. 26, 1955 to J. Turner discloses a filtering arrangement in which a spiral wiping bar wipes the inside of a cylindrical filter medium to remove accumulated dust. The wiping spiral leaves a sufficient build-up of particulate material on the filter to allow the filtering of finer particles to continue. Turner is only one example of a large number of prior devices for physically removing dust from filter surfaces.

U.S. Pat. No. 3,653,189 issued Apr. 4, 1972 to Y. Miyake, et al. discloses a two-stage filter vacuum cleaner. The initial discussion in the patent discloses that in order to allow a longer vacuum period it has previously been known to use a two-stage filtering system comprising a dust collecting receptacle with a filtering screen of relatively large mesh size and a second fine mesh size filtering medium located immediately down-stream from the first course filtering screen. The invention of the patent involves a two-stage filtering arrangement including a first course filter screen made of plastic material, fine metal wires or the like and having a relatively large mesh size. Immediately behind is a main filtering means comprising a filter cloth having a fine mesh size which collects the finer dust particles. Also disclosed is a vibrator for use in shaking the dust from the main filter cloth.

U.S. Pat. No. 3,609,946 issued June 28, 1968 to H. Nakagawa et al. discloses a two-stage electric suction cleaner including a relatively coarse mesh filter and a finer mesh filter. As disclosed the coarse filter is less susceptible to clogging and the finer mesh filter does not have to handle as much dust as it would in the absence of the coarse filter. The period of cleaning is thus increased. As disclosed, the size of the holes, particularly in the coarse filter, is closely related to the period of efficient dust collection. This relationship is shown in the graph in FIG. 8 of the patent. FIGS. 10, 11 and 12 disclose a dual arrangement including two concentric bag or cylinder type filter means.

U.S. Pat. No. 3,653,190 issued Apr. 4, 1972 to W. J. Lee et al. discloses a vacuum cleaner arrangement including a lower canister which may be lined with a plastic bag or bags to receive detritus dropped from a series of upper filter mediums. A vacuum arrangement is provided in the walls and bottom of the canister to hold the plastic bag against the sides of the canister.

U.S. Pat. No. 3,835,626 issued Sept. 17, 1974 to Y. Miyake, et al. discloses a two-stage vacuum cleaner incorporating a first relatively coarse mesh adjacent a dust storage chamber followed by a conventional cloth filter which accomplishes the final filtering of fine dust particles. The initial filter screen may be made of plastic materials, fine metal wire, or the like and has a relatively large mesh size. The second filter means is in the form of a dust collecting bag made from cloth or the like for collection of fine dust particles. The two-stage filtering arrangement provides longer time periods between filter cleaning cycles.

While prior devices such as shown in the Yonkers U.S. Pat. No. 2,198,506, where the filter medium is smooth and non-adherent so large accumulations of dust cannot form, and the Wilson U.S. Pat. No. 2,295,984 where the filter collapses at the end of a suction cycle causing dust to be ejected, are in effect self cleaning, such devices have not proved completely satisfactory since in most cases too much dust is removed, seriously decreasing the efficiency of the filtering action and in the case of the Wilson arrangement the filter cleaning cycle only occurs when the filtering cycle is interrupted.

It is a primary object of the present invention, therefore, to provide an industrial vacuum type cleaner which is substantially self cleaning.

It is a further object of the invention to provide a multiple stage vacuum cleaner which can be used for the collection of extremely fine or toxic, acid or otherwise dangerous materials.

It is a still further object of the invention to provide a combination of filter cycles and a filter arrangement whereby toxic materials can be deposited in a closed bag or other receptacle, both during cleaning of the surroundings and self cleaning of the filter apparatus and which is easily disposable thereafter.

It is a still further object of the present invention to provide a filter and particularly an initial filter medium in a multi-stage vacuum or suction cleaning arrangement, which filter because of its structure and arrangement periodically cleans itself without interrupting the cleaning cycle and without removing all the dust accumulation and seriously interfering with the efficiency of the filtering cycle.

It is a still further object of the invention to provide a multi-stage vacuum system with very superior and enhanced efficiency due to the incorporation of a filter medium having self-cleaning characteristics and from which the filtered dust may be conveniently and efficiently removed without contamination of the immediate environment.

Other objects and advantages of the vacuum of the invention will become evident from the following description and drawings.

BRIEF DESCRIPTION OF THE INVENTION

The present invention provides an improved vacuum or suction type filter medium which is self cleaning by reason of the arrangement of the flow, the size of the mesh, areas of the filter, and the materials of the filter and which can be used in various applications including use in toxic environments. Preferably the self cleaning filter medium is used in combination with other stages of filtering and also with an arrangement whereby dust and other particulate matter, and particularly heavier particulate matter, is deposited in an impervious disposable plastic container or bag. A high proportion of the heavier material is deposited directly into an impervious container such as said plastic container or bag disposed below the self cleaning filter medium. Most of the remainder of the dust and particulates is collected on the self cleaning filter medium which is in the form of an inverted bag or closed end cylinder positioned over the impervious container in position such that as the filter periodically cleans itself the accumulation of dirt and particulates falls into the impervious container. The filtered air then passes either to the atmosphere or preferably to a further stage or stages of filtering, preferably using close weave filter material which removes very fine dust or particulate material which has passed through the first stage filter. Only a relatively minor amount of dust or particulates will be collected on the subsequent stage filters due to the superior filtering on the first stage self cleaning filter. Consequently, the second stage and any subsequent stage filters will only infrequently require cleaning or changing. Any such cleaning or changing will be too infrequent to interfere with substantially continuous use of the vacuum cleaner mechanism and can be carried out during normal periods of inactivity after normal working hours, between shifts or at other inactive times.

The filter medium used in the first stage or single stage of the apparatus, as the case may be, is preferably formed from a plastic material with a fairly course weave such as 90 to 95% shade cloth which has an opening to cloth ratio of 5 to 10% or even more preferably where available a 90 to 92% shade cloth having an opening to cloth ratio of 8 to 10%. The total open area of the filter as a whole should also be preferably at least 12 times the cross sectional area of the smallest substantial continuous length of conduit or duct which conducts dust laden air from the exterior of the apparatus to the interior. With increasing open area of the filter in relation to the inlet area up to as much as 48 times the inlet area the filter tends to be increasingly actively self cleaning. A layer of dust and particulates quickly builds up on the filter material which is disposed preferably both vertically and horizontally, i.e. on the inner portions of the sides and underside of the top of a bag or closed top cylinder of the filter material. The permeability of the filter material to air may cause a quick build-up of a dust layer which quickly acts itself as a filter medium. While the exact details of the reason the filter operates so efficiently is not completely clear at the present time, it is thought that the combination of the filter area, the size of the orifices of the filter medium resulting in total air permeability of the filter medium as well as the relative position of the filter is such that the initial layer or layers of dust and particulates are closely adherent to the filter material due to the pressure of the air passing through the dust and is opposed by gravitational force. Unlike filter mediums having a lesser amount of open space such as, for example, the popular 1% or less openings in many commercial and other type vacuum cleaners; the filter of the present invention is not quicky blinded so that a significant flow of air continues through the dust layer and the filter. As, however, the air flow decreases particularly in the outer portions of the dust layer, the air flow exerts less force against the layers of dust accumulation and finally the weight of the layers of dust accumulation overcomes the counterforce of the air passing through the dust in the opposite direction and the outer layers of dust separate and fall into the impervious container below. The dust layers on the sides of the filter medium shear off the sides and the dust layers on the underside of the top of the filter medium peel away and drop into the underlying receptacle. The separation of the dust layers is very complete so that nearly all the dust and possibly substantially all is removed from the filter material. It can be broadly stated, therefore, that it is presently believed at least that the apparatus of the invention operates so efficiently because it takes advantage of Stokes Law in maintaining particulates on the filter by the force of the air passage and then periodically partially sloughing off the outer portions of such layers.

Since the innermost layers of dust are still being acted upon by the air passing through the filter medium, particularly as the outer layers peel from the underlying layers, the immediate underlying layer may not separate from the filter medium. Thus, a filtering dust layer may usually remain on the filter medium. After the outer layer of dust and particulates falls away, a new outer layer immediately begins to form and the cycle repeats itself. Separation of the outer and inner layers of dust and particulates does not necessarily, but tends to, occur at the same point every time. The continual sloughing off of the outer layers of dust and particulates while the inner layers are retained due to the force of a high volume of air passing through the inner layers, both cleans the filter so it does not lose efficiency due to any excess accumulation of particulates and at the same time maintains its efficiency in filtering out small particulates.

The vacuum apparatus of the invention can be used not only on dry, but on wet materials and has been found to be much more efficient than previous vacuum or suction cleaners. The vacuum of the invention, as pointed out above, is particularly useful for collecting and disposing of dangerous materials such as asbestos, radioactive dust and the like because of its high efficiency in (a) sucking up small and large particulates, (b) removing all such particulates from the air stream before it is discharged to the environment, (c) safely bagging such materials for disposal and (d) maintaining a long operating cycle between servicing and removing dust accumulation. Other advantages and details of the vacuum or suction cleaner of the invention will become evident from the following drawings and description.

While the preferred open area to cloth ration of the filter medium is 8 to 10% and the total open area of the filter is preferably 12 or more times the cross sectional area of the smallest continuous internal diameter of the dust laden air inlet into the apparatus, the opening to cloth ratio can preferably be 5 to 10% or less preferably 6 to 12% and less preferably still from about 5 to 14% and the total open area filter area to inlet area can be less preferably from 8 to 48 times and less preferably still from 5 to 48 or more times the inlet area.

DESCRIPTION OF THE PREFERRED EMBODIMENTS

The present invention provides a superior, efficient vacuum or suction cleaner which is particularly suitable for handling dangerous materials such as toxic materials and the like, but which is also useful for normal industrial and household vacuuming of both wet and dry materials. The vacuum is rendered particularly efficient because of its use of a special open mesh filter material which provides excellent filtering of dust and particulates, particularly after a fairly heavy layer of dust and particulates are accumulated on the filter, but which is, on the other hand, self cleaning due to the effect of gravity after a certain accumulation of dust and particulates have collected upon the filter.

Figure 1:
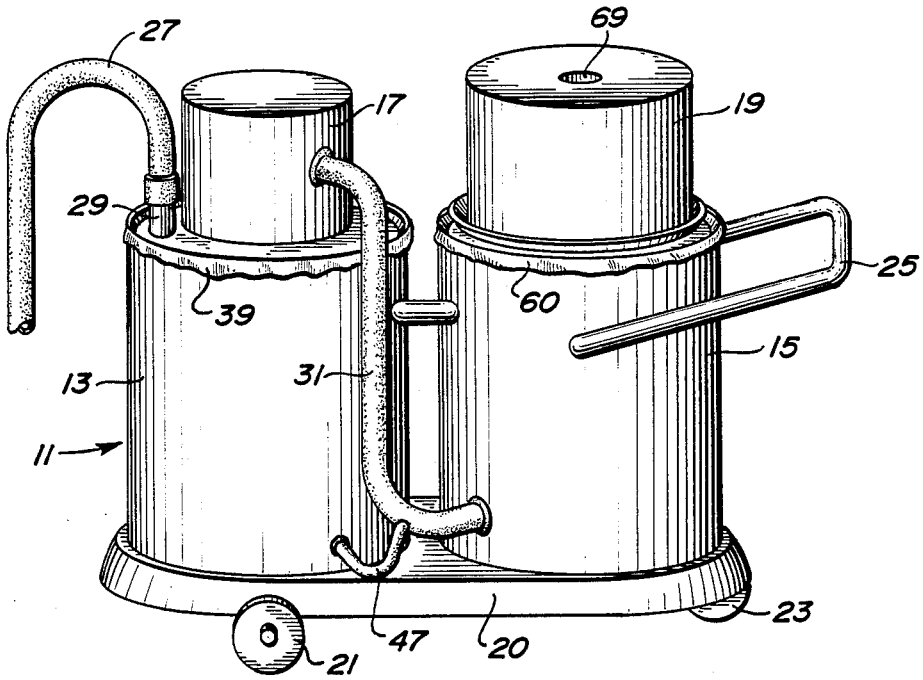
FIG. 1 is an isometric view of the exterior of one embodiment of the cleaner of the invention.

A vacuum apparatus incorporating the invention is more particularly illustrated in FIG. 1 in which the vacuum filter apparatus 11 is shown as comprising two more or less cylindrical tanks 13 and 15 having cylindrical filter and fan casings 17 and 19 respectively mounted on top. The two tank units 13 and 15 are mounted on a base 20 having two wheels 21 (only one of which is visible in FIG. 1) at one end and one swivel caster type wheel 23 at the other end. A handle 25 is mounted upon the tank unit 15 for steering the vacuum apparatus 11. A suction hose 27 is mounted at one end of the apparatus 11 upon a suction pipe 29 which connects with the interior of tank 13 as will be more evident in FIG. 2. An interconnecting suction tube or main 31 extends between the filter casing 17 on tank 13 and the lower portion of tank 12.

Figure 2:
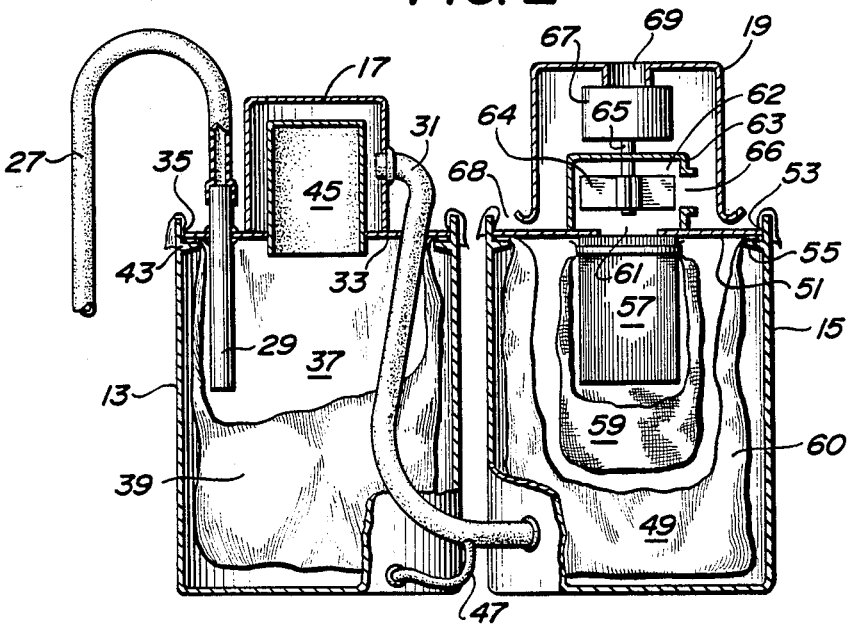
FIG. 2 is broken away view showing the interior of the cleaner of FIG. 1.

FIG. 2 is a schematic illustration of the interior of the vacuum apparatus. In FIG. 2 it will be seen that the suction tube or pipe 29 extends downwardly into the tank 13 which is provided with a tight fitting cover 33 having a sealing edge 35 about the circumference. Within the tank 13 is a dust or debris collection chamber 37 in which is suspended an impervious plastic bag 39 which may be in the form of a strong garbage bag. This bag is simply supported by having its edges 41 folded over the top of the circumference of the tank 13 between the sealing edge 35 of the cover 33 and a corresponding sealing edge 43 on the top circumference of the tank 13. The top overlap of the plastic bag 39 thus forms in effect a sealing gasket between top edge 43 of the tank 13 and the sealing edge 35 of the cover 33.

At the top of the chamber 37 is positioned an inverted primary filter 45 made from 90 to 92% woven extruded flat polypropylene cloth and having an opening ratio of 8 to 10%. The filter cloth is formed from polypropylene or other similar suitable plastic and has a relatively loose but constant flat weave. Other materials from which the filter 45 could be formed would be, for example, polyethylene and other polyolefins.

The primary filter 45 is in the form of a cylinder with a closed top. It extends into the filter casing 17 which completely surrounds it and any vacuum or suction imposed in the casing 17 through the suction tube or main 31 completely surrounds the filter 45 from all sides. A vacuum take-off 47 from the lower portion of the suction main 31 enters the lower section of the tank 13, preferably, as shown, below the plastic bag 39 so that the same pressure or a vacuum is imposed on the outside of the plastic as is imposed on the inside. This equalization of pressure, or vacuum, prevents the bag from being drawn up into the filter 45. This essentially allows the plastic bag to remain in the exact position as it is installed by the operator. The operator should therefore take care to open the bag completely as it is installed.

As indicated the suction tube or main 31 interconnects with the inside of the second tank 15. Tank 15 is also closed at the top with a lid 51 having a sealing edge 53 with a corresponding edge 55 on the top of the tank 15. Suspended from the top or lid 51 is HEPA (high efficiency particle air) filter 57 over which may be stretched a nylon cloth filter 59 having a very fine weave so it will remove very small dust particles from air prior to its passage through the HEPA filter. A central orifice 61 in the lid 51 provides an air passage from the HEPA filter 57 to a centrifugal chamber 62 within centrifugal casing 63 in which the blades or rotor 64 of a centrifugal fan or blower are arranged for rotation on the shaft 65 of an electrical motor 67. An air passage 66 leads from one side of the centrifugal chamber 62. An air ejection passage 68 is also provided about the lower periphery of the fan casing. While the nylon cloth filter 59 is preferred, it can be eliminated if desired or replaced by another suitable filter medium.

Figure 3:
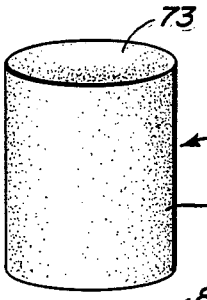
FIG. 3 is an isometric view of the preferred filter medium of the first filter stage of the cleaner of FIGS. 1 and 2.

FIG. 3 is an isometric view of the primary or first stage filter element 45 shown in FIG. 2. It will be noted that the preferred shape of the filter is a closed top cylinder having cylindrical sides 71 and a top 73, all made from the 90 to 92% polypropylene cloth.

It has been found that the primary filter 45 should also have a total open area of 12 or more times the cross sectional area of the smallest of the vacuum hose 27, the suction pipe 29 or any other substantial constriction in the passage of the dust laden air into the chamber 37.

While the filter 45 preferably has an opening area ratio of 8 to 10% the filter may less preferably have a 5 to 10% open ratio or less preferably still a 6 to 12% open ratio and even less preferably still a 5 to 15% open area ratio. Also, while it is preferable for the total open area of the filter 45 to be 12 or more times the open cross sectional area of the smallest continuous open interior section of the inlet to the chamber 37, it can less preferably be 8 to 48 times such are or less preferably still 5 to 48 times such area.

A desirable air flow through the filter 45 during operation is from 0.2 to 1.0 cubic feet per minute per square inch of filter at a pressure drop of 90 to 200 inches of water ($H_2O$) across the filter. Depending upon conditions, however, higher or lower air flows can be used.

It is preferable for the gas permeability of the filter membrane to be no more than 0.17 cubic feet per minute per square inch at a pressure drop of about 94 inches of water.

It will be understood that during operation of the vacuum filter apparatus shown in FIGS. 1, 2 and 3 upon activation of the motor 67 with current from any suitable source, not shown, the centrifugal blades of rotor 64 will be rotated throwing air to the periphery of the centrifugal chamber 62 where it exits from the air passage into the interior of the fan casing 19 and thence through circumferential air ejection passage 68 to the atmosphere. Air to replace the ejected air is drawn into the centrifugal chamber 62 through the air passage 61 through the fine mesh of the HEPA filter 57 and the protecting nylon filter 59 from the chamber 49. Very fine dust may in the process be caught on the filter 59. A plastic or paper particulate bag 60 is preferably positioned in the bottom and sides of the filter chamber 62. As air is exhausted or drawn from chamber 49 of the second stage filter apparatus it is replaced by air drawn through the suction tube 31 from within the filter casing 17 drawing air in turn through the filter medium 45 which removes the majority, or almost all, of the dust particles from the air. A previous accumulation of dust upon the filter medium aids in removing small dust particles from the air, that is to say smaller particulates than would normally be stopped by the mesh of the filter 45.

Air passing through the filter 45 is replaced in chamber 37 by air drawn through vacuum suction hose 27 and suction pipe 29. The air stream passing through suction hose 27, of course, draws in dust and dirt from the environment immediately adjacent and surrounding the end of the suction hose 27 or any suction tool or other device mounted on the end of the hose. An equal pressure, or vacuum, is established in the bottom of the tank 13 on the outside of the plastic bag 39 and this equal pressure, or vacuum, maintains the plastic bag 39 in the bottom of the tank 17 and prevents it from being drawn up into the filter 45.

It will be understood that as dirt and particulate laden air is drawn downward through the suction pipe 29 at high velocity and suddenly expands into the large space 37 in the tank 13, the sudden slowing down and expansion of the air stream as it enters the larger space 37 within the plastic bag 39 will cause a large amount of particulates to drop by gravity out of the air stream and fall or settle into the bottom of the bag 39. It is desirable in this respect for the dust laden air to be directed from the end of the suction tube 29 downwardly directly at the lower portion of the plastic bag 39. The air then is drawn upwardly into the filter 45 through which it passes leaving the major portion of any remaining dust on the inside surface of the filter 45. The deposit of dust and other particulates builds up in filter 45 until the weight of the accumulation causes the outer layers of particulates to be pulled more strongly by gravity than they are forced toward the filter by the air passing through the dust accumulation. At this point the outer layers of dirt and particulates separate and fall downwardly into the plastic bag 39. A new outer layer of dust and particulates then immediately begins to form upon the base of particulate material already deposited and the cycle repeats itself. The efficiency of the filter thus continues essentially undiminished until the bag 39 accumulates a full load of dirt and debris and must be changed. The point at which this occurs is controlled somewhat by how far the suction pipe 29 extends into the bag 39, as the efficiency of the device will decrease when the level of the particulates reaches the lower end of the suction pipe 29 and then exceeds the level of the lower end of such pipe. When this happens efficiency is restored when the plastic bag 39 is removed and replaced. The bag is removed by first removing the top 33 of the tank 13. The top of the bag may be closed and secured before removal from the tank 13 in any suitable manner to keep the contents from spilling.

Figure 4:
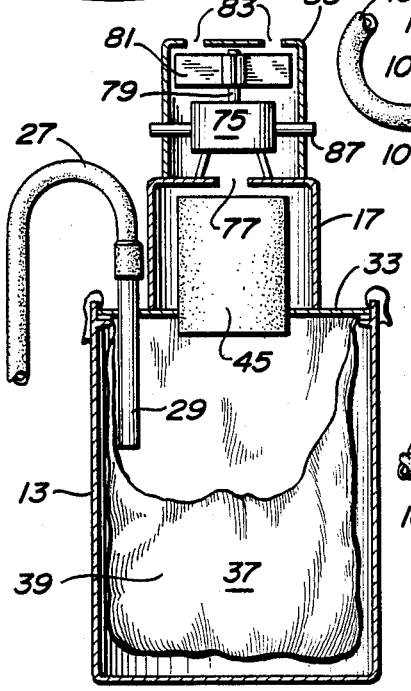
FIG. 4 is a schematic view of a further embodiment of the invention having only a single stage of filtering.

FIG. 4 is a schematic view of a further embodiment of the invention in which there is only a single stage of filtering. Where the parts are the same the same reference numerals are used as in the multistage embodiment of the invention shown in FIGS. 1 and 2. Thus there is a tank 13 having a cover 33 with a suction pipe 29 extending therethrough and a filter 45 extending through the top 33 contained within a filter casing 18. A motor 75 is positioned above and mounted on the filter casing 17 above an exhaust port 77 in the top of the filter casing. The motor 75 has a shaft 79 at the upper end upon which are mounted fan blades 81 adjacent to exhaust ports 83 in motor casing 85. Cooling passages 87 pass from the exterior of motor casing 85 to the lower portion of the motor 75, the lower portion of which is preferably closed to prevent the entrance of dust into the motor with any air in which the dust may be entrained passing through exhaust port 77. Operation of the fan blades 81 draws air through the exhaust port 77 in filter casing 17, draws such air past the motor extracting heat from the motor and by aspiration draws air from the top of the motor and passes it out the exhaust ports 83 with the air from the filter casing 17. The hot air withdrawn from the top of the motor is replaced with cooler outside air drawn through cooling passages 87 into the motor. The filter 45, which in FIG. 4 constitutes the sole filter stage, is the same as in the first stage filter used in the multistage filter arrangement shown in FIGS. 1 and 2. The filter is self cleaning through the effects of gravity as in the previous embodiment and a very efficient filter system is provided. It will be understood that a plastic bag similar to the plastic bag 39 in space 37 in FIG. 2 may also be used in the apparatus of FIG. 4 with suitable vacuum equalization conduits.

Figure 5:
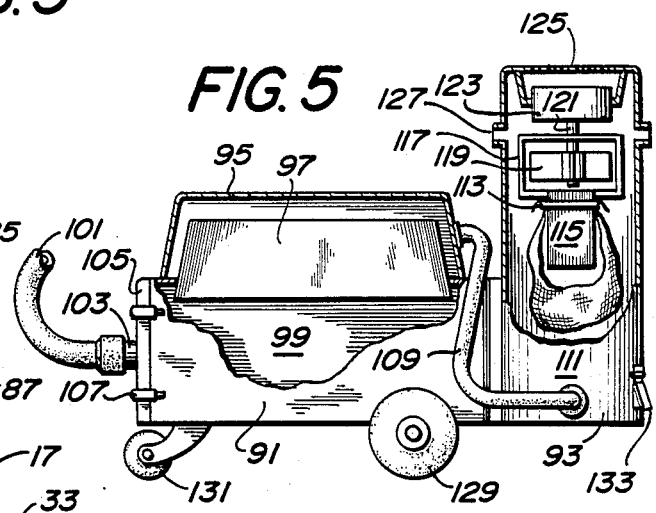
FIG. 5 is a partially broken away side view of a still further embodiment of the invention having a different initial filter stage.
Figure 6:
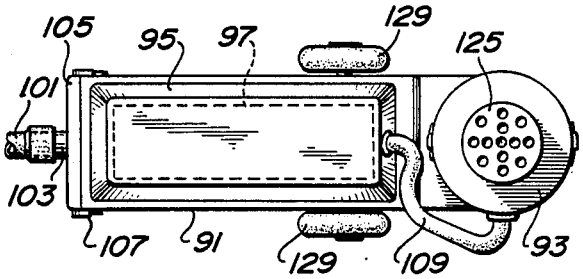
FIG. 6 is a plan or top view of the embodiment of FIG. 5.

FIGS. 5 and 6 show a further embodiment of the invention. FIG. 5 is a partially broken away side view and FIG. 6 is a top or plan view of the same apparatus with the filter casing removed to show the filter. In FIG. 5 there is seen a portable type vacuum cleaner comprising an elongated horizontal tank 91 at one end of which is attached a shorter vertical tank 93. Upon the top of the horizontal tank is an elongated filter casing 95 surrounding an elongated inverted filter 97 which is the primary or initial filter of a two stage filtering arrangement. The elongated inverted filter 97 is made from a plastic material having the same physical and chemical characteristics as the filter 45 in the previously described embodiments, but the filter has a different, i.e. a more elongated shape to adapt it to the shape of the other components of the vacuum. Within tank 91 is a particulate collection space 99 into which dust and particulates pass after passing through vacuum hose 101 and vacuum inlet 103 in the end closure 105 of the tank 99. Hinged clamps 107 of any suitable type hold the end closure 105 to the end of the tank 91 during operation. The upright tank 93 which is attached to the opposite end of the tank 91 is connected to the inside of the filter casing 95 by vacuum tube or main 109. The lower portion 111 of tank 93 constitutes a dust accumulation chamber 112, only partially shown, into which extends a perforate filter holder or mounting 113 over which is mounted a fine mesh cloth or paper filter 115. The filter holder 113 connects to the bottom of a fan casing 117 in which the rotor 119 of a centrifugal type fan operates on the shaft 121 of a motor 123. Air cooling passageway 125 leads from the exterior of the tank 93 to the motor 123 to cool the motor and there are also exhaust orifices 127 in the side of the tank 93 to exhaust air derived both from the centrifugal rotor 119 and cooling air from the interior of the motor 123. Wheels 129 and swivel caster 131 provide mobility to the vacuum apparatus. A hinged door or trap 133 provides access to the interior of the dust accumulation chamber 112 for removal of debris and the like.

In operation, upon activation of the motor 123 the centrifugal rotor 119 withdraws air from inside the filter holder 113 which causes air to pass through the filter 115 to replace the exhausted air. Fine particles of dust are removed from the air as it passes through the filter 115 and air is withdrawn from the filter casing 95 through vacuum tube 109 to replace the air. Dust particles tend after passing through tube 109 into dust accumulation chamber 112 to fall to the bottom of the chamber and accumulate in the bottom. Any very fine dust passes with the air to the filter 115 for final removal. The air exhausted from the filter casing 95 is replaced by air from the particulate accumulation chamber 99 which air passes through the filter medium 97 where most of its dust and particulate content is removed. As in the previous embodiments, the dust layers build up on the inside of the filter 97 initially increasing the filtering efficiency and finally the outer layers of dirt slough off and fall into the bottom of the dust accumulation chamber 99. The dust and other particulates, which originally passed through the hose 101 and vacuum inlet with indrawn air can be removed from the chamber 99 by disengaging the hinged clamps 107 and removing the end closure 105 while inclining the entire vacuum device so accumulated particulates slide out. All internal surfaces of the filter 97, i.e. the dust or particulate collecting surfaces of the filter, should be disposed at an angle of from 90 to 180 degree of horizontal, i.e. be vertical or else at least partially downward facing, in order to facilitate self cleaning of the filter. It is also desirable for the apparatus in FIGS. 5 and 6 to be provided with a plastic collection bag similar to that shown in FIGS. 1 and 2.

Figure 7:
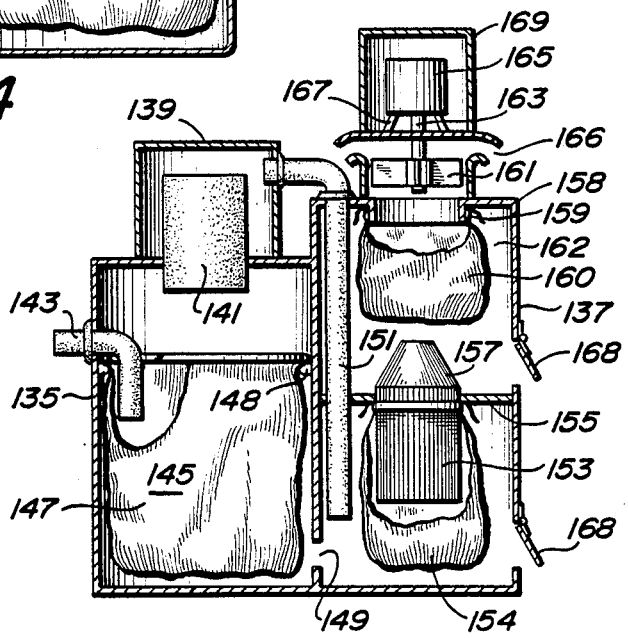
FIG. 7 is a still further embodiment of the invention incorporating three filter stages.

FIG. 7 is a schematic representation of a three stage filter arrangement in accordance with the invention. The apparatus of FIG. 6 is comprised essentially of two tanks 135 and 137. The first tank 135 has a filter casing 139 within which is an inverted primary filter 141. A vacuum inlet 143 passes into the central portion of the tank 135 to discharge particulate laden air into the particulate collection space 145 within an impervious plastic bag 147. The plastic bag is secured to a circumferential clamp 148 which secures the top of the bag. A pressure equalization passage 149 connects the lower portion of the tanks 135 and 137. A vacuum tube or main 151 also extends from and interconnects filter casing 139 with tank 137. A perforate filter holder 153 is supported on a partition 155. Baffles 157 are attached to the top of filter holder 153 so that air passing through the filter holder 153 is accelerated and centrally directed. The baffles also at least partially prevent detritus from falling through the filter holder. There is a second perforate filter holder 159 secured in place on semicircular partitions 158 above the first holder 153. A large fan 161 is located in the top of the tank 137 above the second filter holder 159. The fan 161 is rotatably supported on shaft 163 of motor 165 which is mounted in turn on supporting brackets 167 all within a motor casing 169. A circumferential exhaust passage 166 exhausts air drawn through the fan 161 to the exterior of the apparatus. A secondary filter 154 is mounted on the filter holder 153 and extends into the second filter section or space 156. A tertiary filter 160 is secured upon the second filter holder 159 and is contained in the third filter section or space 162. Cleanout openings with a hinged cover 168 are provided in the bottom of the tank 137 in both the secondary and tertiary filter sections.

It will be recognized that the fan 161 pulls or sucks air and debris through filters 160 and 154. Air in turn passes through the filter 141 and into the filter casing 139 from where it passes via the vacuum tube or main 151 into the second filter section 156. Pressure equalization passage 149 allows the reduced pressure in the second filter section 186 in the bottom of tank 137 to be transferred to the bottom or lower end of tank 135 to retain the impervious plastic bag 147 in the lower portion of the tank. As in the earlier embodiments of the invention dust and other particulates build up on the inverted filter 141 and after a certain amount of such material has collected the outer layer will slough off to renew the filter surface.

Figure 8:
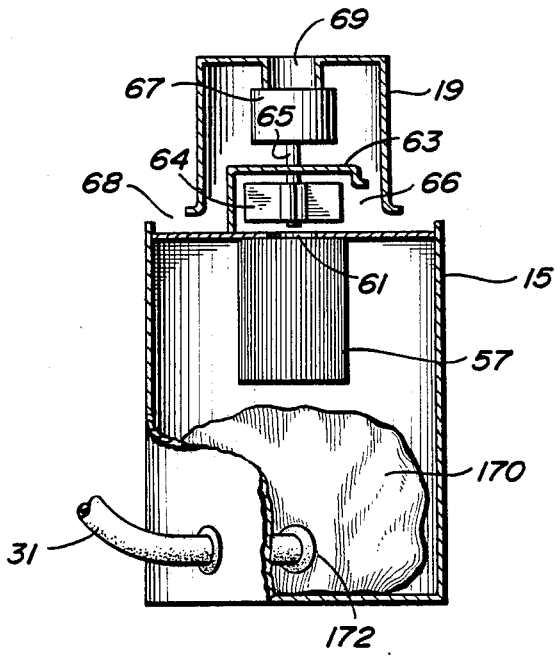
FIG. 8 is a broken away elevation of an alternative embodiment of the second stage of the invention.

FIG. 8 is a broken away elevation showing the inside of the second stage or second tank of a very desirable alternative embodiment of the cleaner shown in FIGS. 1 and 2. In such alternative embodiment the plastic particulate bag 60 is replaced by a paper filter bag 170 into which the suction tube 31 passes with a tight fitting substantially dust proof connection 172 as known in the art. This arrangement effectively converts the cleaner shown in FIGS. 1 and 2 into a three stage rather than a two stage cleaner, which is extremely efficient in operation and dust removal. The other elements of the apparatus shown in FIG. 8 are the same as in FIGS. 1 and 2 and the same reference numerals are used to refer to the same structures. The paper filter bag after becoming full of particulates may be readily removed from the tank 15 by removing the cover 51 and the contents of the paper filter bag 170 disposed of, or, more frequently, the entire bag will be disposed of. One of the advantages of paper filter bags is disposability. Since the filter 45 is so efficient, and substantially self cleaning besides, the filter bag or container 170 or its contents needs to be removed and disposed of only infrequently. The nylon plastic filter 59 may or may not be used over the HEPA filter 57 as shown in FIG. 2 when the improved arrangement shown in FIG. 8 is used since the paper filter bag 170 does an excellent job of removing excess particulates and dust from the discharge from vacuum tube 31 prior to contact with the HEPA filter. The fine plastic filter medium 59 is consequently not shown in FIG. 8. However, it will be understood that additional protection for the HEPA filter will be provided by the use of a filter 59 as shown in FIG. 2.

The same paper filter bag arrangement as shown in FIG. 8 may be used with the three stage cleaner shown in FIG. 7 and if used will effectively convert the embodiment of FIG. 7 into a four stage, as contrasted to a three stage, cleaner with additional efficiency and effectiveness, particularly where very fine dust and particulates are to be removed from a large amount of air. In using a paper filter bag 170 as shown in FIG. 8 in the embodiment shown in FIG. 7, it may be desirable to enlarge the lower clean out door 168 to facilitate removal and replacement of such filter bag when necessary.

It may be convenient where a paper filter bag as shown in FIG. 8 is used in the apparatus of FIG. 2 to have the suction tube or main 31 pass through the lid 51 of the tank 15 as a rigid tube and be connected with the paper filter bag 17 by means of a flexible tubing.

It will be understood that although the present invention has been described in considerable detail in connection with the accompanying figures and description, all such description and showing is to be considered as illustrative only and the invention is not intended to be narrowly interpreted in connection therewith, but should be interpreted broadly within the scope of the delineation of the invention set forth in the accompanying claims.

I claim:

1. A self cleaning high vacuum type suction cleaner comprising:

(a) a particulate receiver, (b) a flexible polymer fabric filter having a relatively large mesh size disposed above and in effective contact on one side with the particulate receiver and on the other side with a vacuum enclosure connected to a rotatable suction means, (c) an inlet into the particulate receiver for particulate laden air, said inlet opening into the receiver below the large mesh fabric filter in a downward direction away from said filter, (d) said flexible fabric filter being formed from a substantially flat polymer thread material having a substantially smooth surface and having a filter open mesh ratio of from 8 to 19% and a total filter open area of 5 to 48 times the cross section of the most restricted portion of the inlet into the particulate receiver, (e) the relatively large mesh fabric filter having a hollow open bottom closed top cylindrical form, (f) the particulate receiver being arranged and constructed to receive a substantially impervious disposable bag in the lower portion thereof, and (g) wherein the lower portion of the particulate receiver is connected to a vacuum source to maintain impervious bags in the bottom portion of said receiver away from the large mesh fabric cloth filter, whereby the filter operates in accordance with Stokes law in that an accumulation of particulates is deposited on the receiver side of the filter under the influence of gas passage through the filter until gravity overcomes mutual adhesion of the particulates and the force of the gas passage whereupon at least portions of the outer accumulation of particulates flakes off and falls into the particulate receiver.

2. The suction of claim 1 wherein the large mesh fabric filter is disposed with all particulate collecting surfaces at an angle of from 90 degrees to 180 degrees of horizontal.

3. The suction cleaner of claim 2 wherein the flexible polymer fabric filter is comprised of 90 to 92% shade cloth.

* * * * *